United States Patent [19]

Miles

[11] 4,374,718

[45] Feb. 22, 1983

[54] ELECTROLYTIC CELL

[75] Inventor: John H. Miles, Ravenna, Ohio

[73] Assignee: Wean United, Inc.

[21] Appl. No.: 261,997

[22] Filed: May 8, 1981

[51] Int. Cl.[3] ..... C25D 17/00

[52] U.S. Cl. ..... 204/202

[58] Field of Search ..... 204/198, 202, 203, 204, 204/205

[56] References Cited

U.S. PATENT DOCUMENTS

| | | | |
|---|---|---|---|
| Re. 26,052 | 6/1966 | Crum | 140/2 |
| 393,170 | 11/1888 | McMurray | 204/203 |
| 1,336,052 | 4/1920 | Pinger | 204/202 |
| 1,544,027 | 6/1925 | Mueller, Jr. | 204/204 |
| 2,695,269 | 11/1954 | De Witz et al. | 204/206 |

FOREIGN PATENT DOCUMENTS

| | | | |
|---|---|---|---|
| 54-138832 | 10/1979 | Japan | 204/206 |

*Primary Examiner*—T. M. Tufariello

*Attorney, Agent, or Firm*—Daniel Patch; Suzanne Kikel

[57] ABSTRACT

This disclosure relates to an electrolytic cell for electroplating a continuous strand of steel wire which is spread out in a series of consecutive circular loops while passing through the electroplating cell. The loops of wire are carried by two or more steel chains spaced apart and designed to convey the wire through the electroplating solution, each chain being supported by a cooperative steel track which also serves as the cathode for transferring current to the chains and hence to the wire.

9 Claims, 4 Drawing Figures

ELECTROLYTIC CELL

BACKGROUND OF THE INVENTION

In the past, in one form employed for electroplating steel wire in a continuous loop manner the cathode condition was created by contacting the upper surface of the wire loop pattern with one or more steel rollers which were connected to the cathode side of a rectifier. The wire in loop form was supported from below for continuous conveyance by a number of rubber-coated steel rollers. This system has proven to possess some disadvantages. For one thing, these steel cathode rollers that contact the wire loop pattern, in time build up with plated material and eventually must be removed and de-plated. This is very costly in terms of man hours consumed and the lost production time. Another condition is related to the use of the upper steel roller or rollers to establish the cathode connection with the loops which allowed only a partial line contact between the roller or rollers and the moving wire loops.

It is an object of the present invention to provide an improved electrolytic cell for cleaning, plating or otherwise treating, elongated material either in a continuous or batch form wherein the material is supported by a steel carrying means such as a chain supported by a steel support such as a track which transfers current to the chain and material to be treated.

It is still another object of the present invention to provide in an electrolytic cell a system for plating wire and the like, wherein steel chains are employed to support the wire loops substantially the entire time the wire is being plated, and adapted to continuously convey the wire in loop form through an electroplating tank in a generally horizontal path of travel, a steel track for supporting each chain in a sliding manner therebetween, substantially throughout the process while supporting the wire, means for causing said track to be connected to the cathode source of the electrolytic plating process in which the electrical current passes through the track, then through the chain and then into the wire.

In another object, the anode tray or trays are supported by, and attached to, one or more steel members which are connected to the anode source of the electrolytic plating process in which these steel members are electrified in the same means as the means used to electrify the chain support tracks.

These objects, as well as other novel features and advantages of the present invention, will be better understood when the following description of a preferred embodiment is read along with the accompanying drawings of which:

Figure 2:
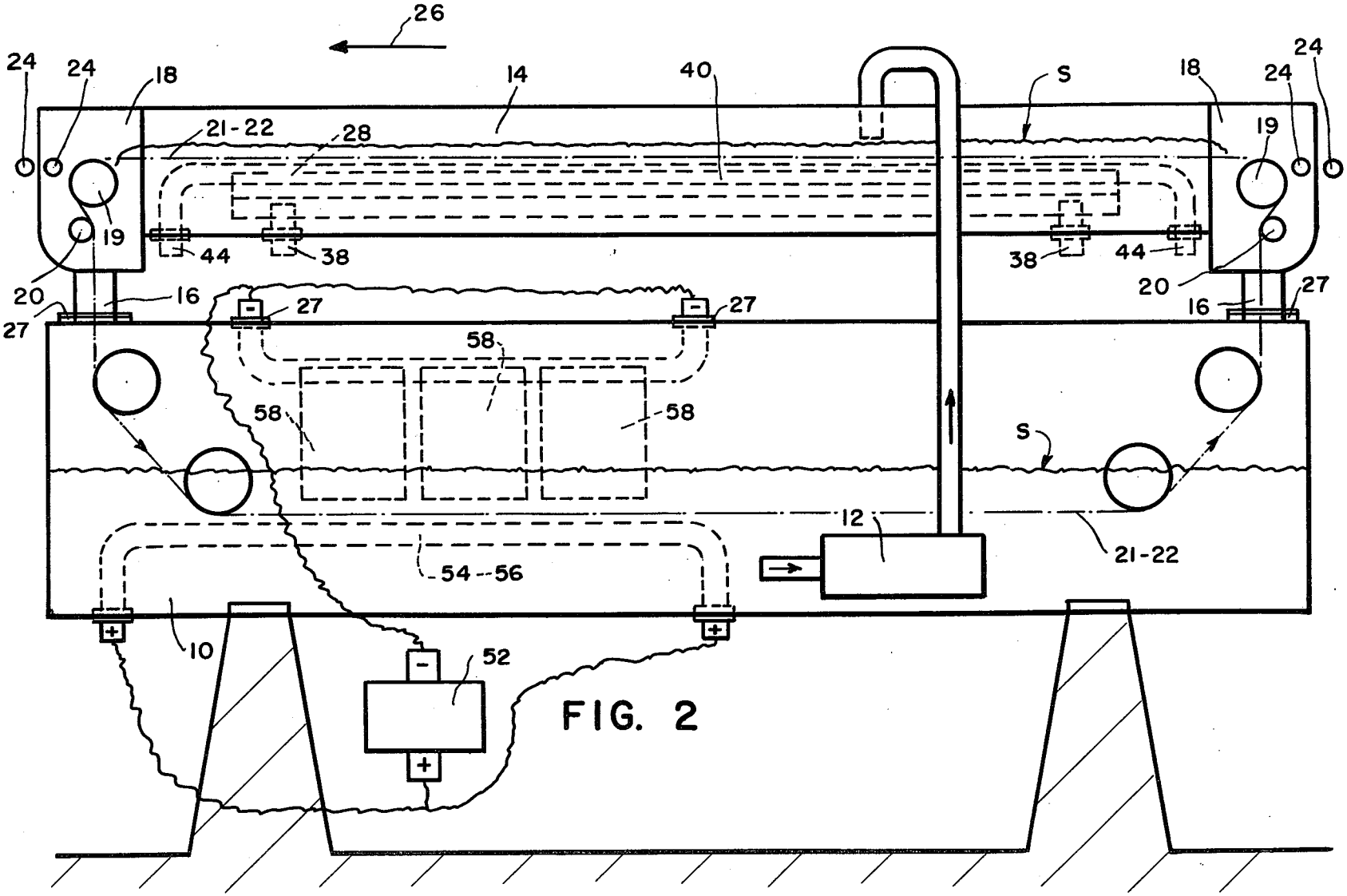
FIG. 2 is an elevational view of the plating system illustrated in FIG. 1.
Figure 3:
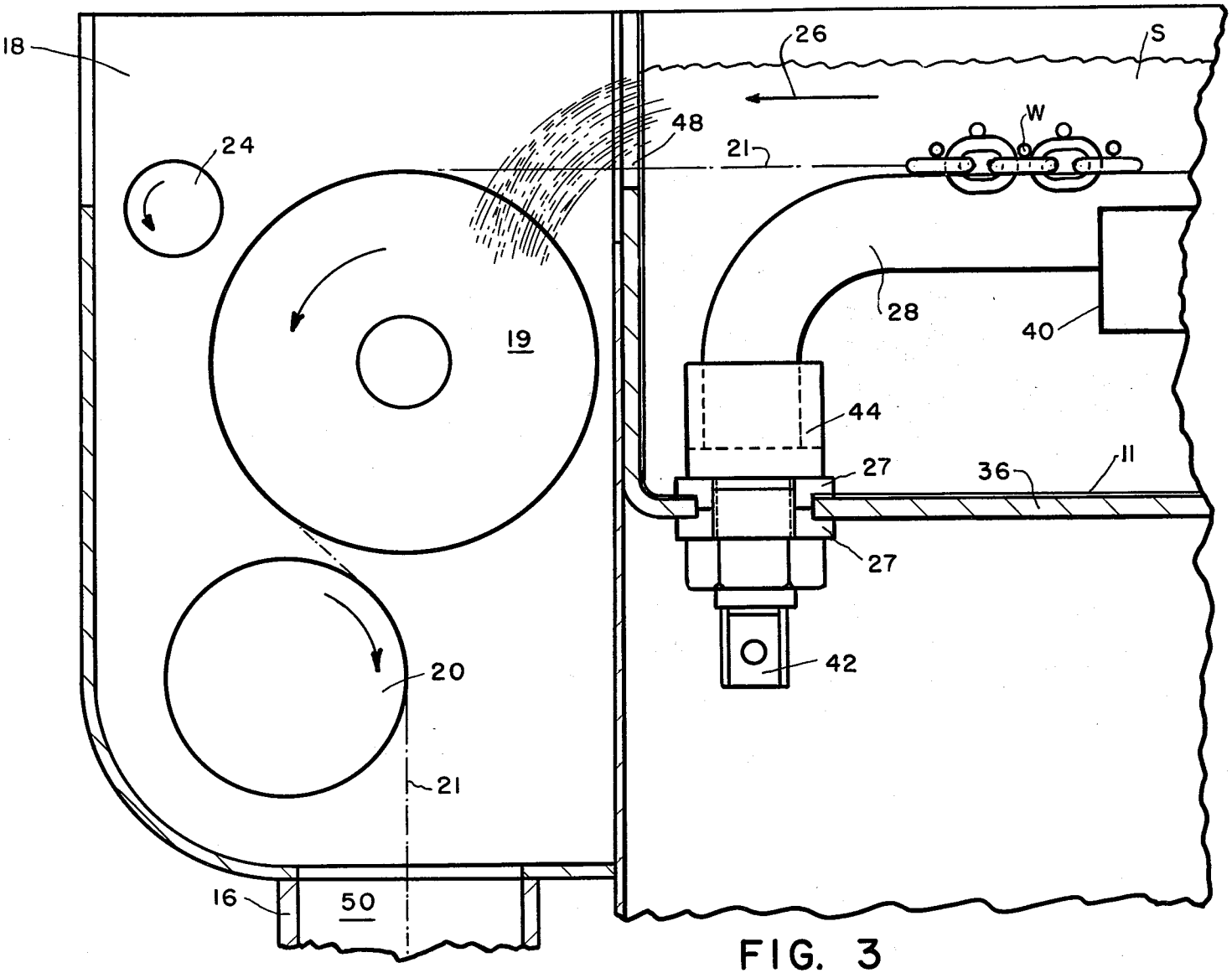
FIG. 3 is an enlarged elevational view, partly in section of the exit end of the plating system illustrated in FIGS. 1 and 2.
Figure 4:
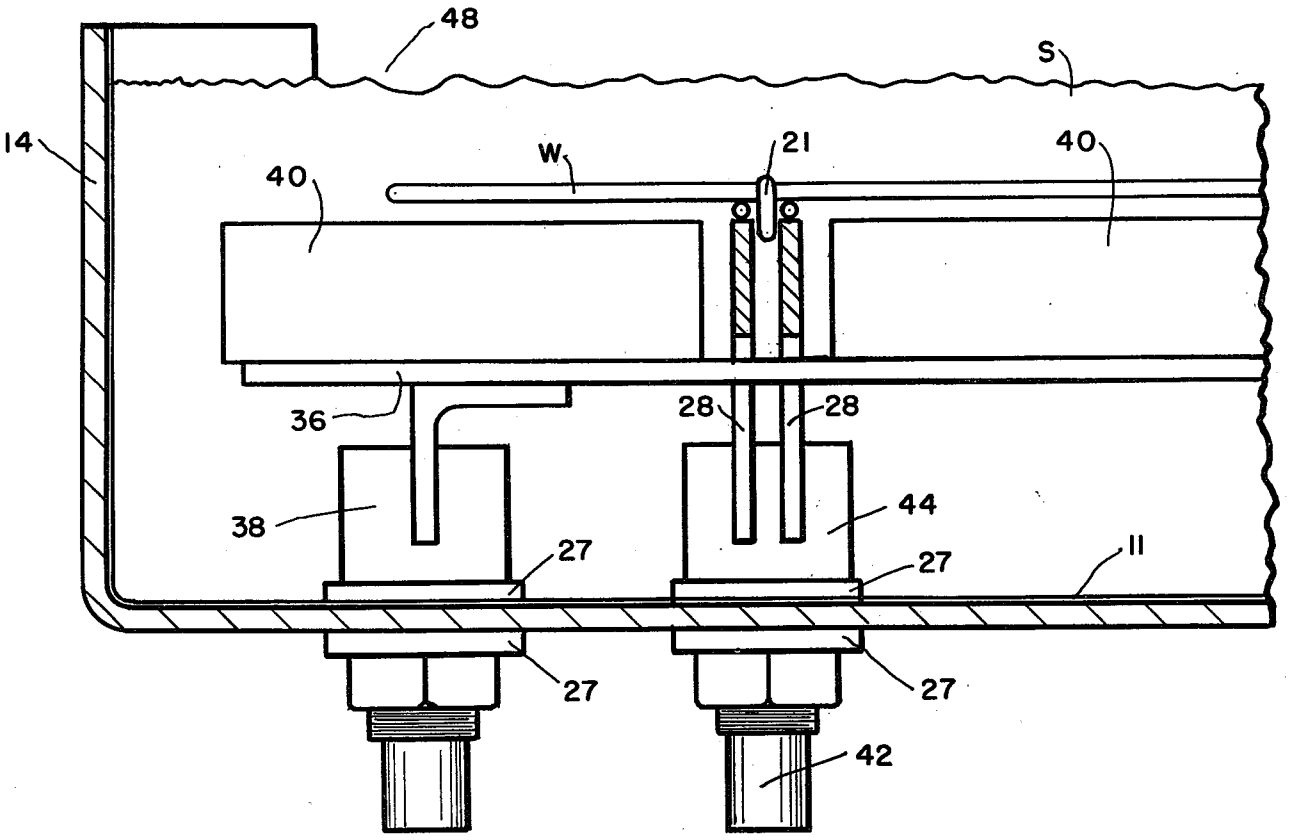
FIG. 4 is a sectional view taken on lines 4—4 of FIG. 1.

In referring first to FIG. 2, there is illustrated an electroplating system for plating steel wire with a uniform coating of copper, zinc or the like. In the illustrated assembly the conveying speed of the wire is approximately 15 FPM, the wire size is approximately $\frac{1}{4}''$ diameter and the loop diameter of the wire is approximately 36″. The system includes a horizontally disposed elongated rectangular holding tank 10. There is a pump unit 12 for continuously feeding the electrolytic solution from the holding tank into a rubber lined upper processing or plating tank 14, smaller in size, but similar in shape to the tank 10. FIGS. 3 and 4 indicate the rubber lining at 11. The plating tank 14 is mounted directly over and is supported by and insulated from the holding tank 10 by end supporting members 16. The members 16 are formed so as not to interfer with the free passage of the wire supporting chains as will be more fully appreciated later on.

Figure 1:
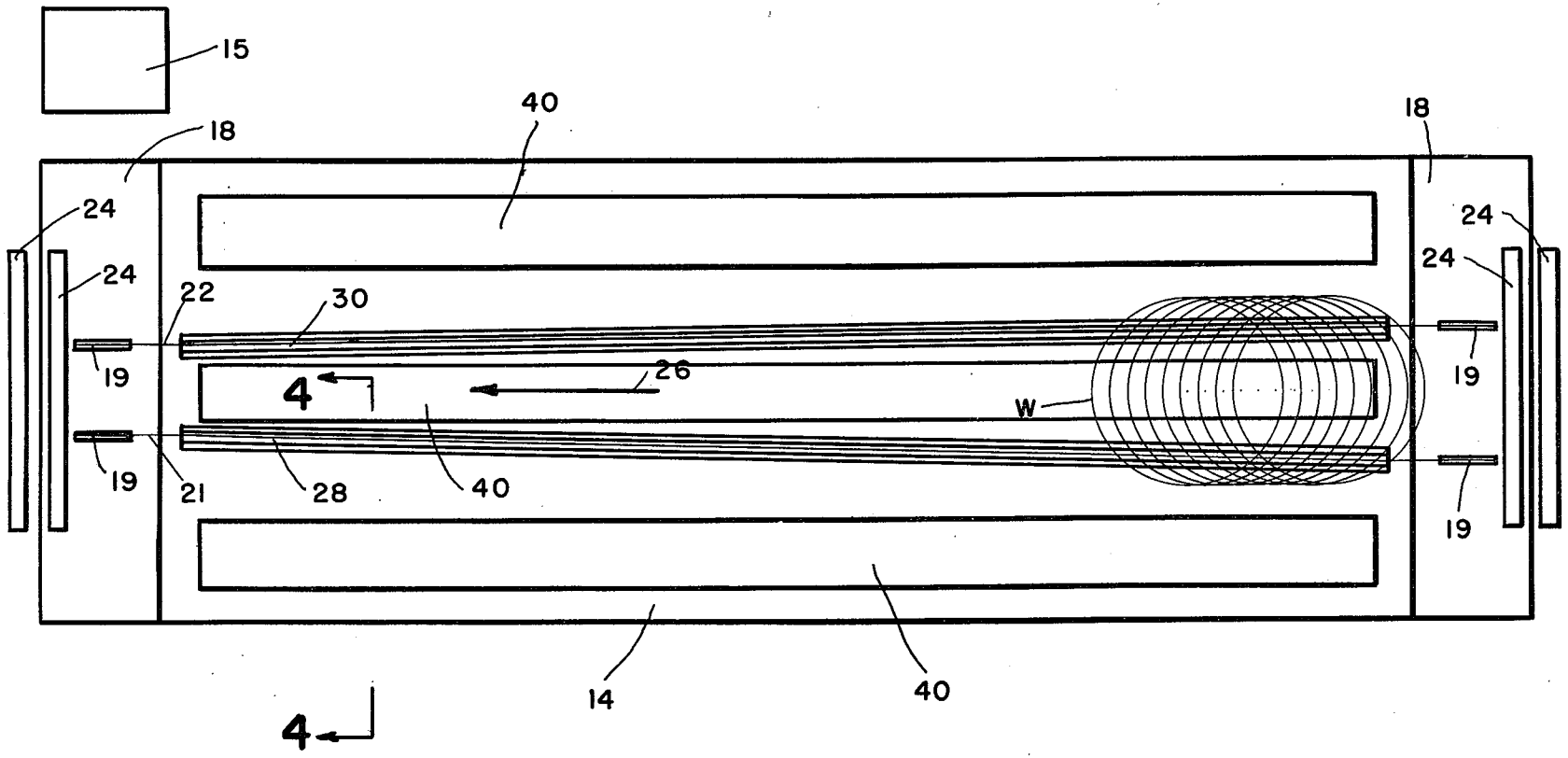
FIG. 1 is a plan view of an electroplating system for continuously plating steel wire in loop form.

The upper tank 14 includes two end members 18 which form standards for the tank and in addition serve to rotatably support a different pair of spaced apart insulated chain sprockets 19 and insulated idler guide sprockets 20 for a pair of linked steel chains 21 and 22. The two chains as illustrated in FIG. 2 are of a continuous type, the lower portion of which passes into and through the tank 10 being guided by insulated idler sprockets and insulated tracks. Also rotatably supported by the standards 18 are transversly arranged insulated support rollers 24 for supporting the wire W as it is continuously fed to and from the tank 14 in loop form in a generally horizontal direction as indicated by the arrow 26 in FIGS. 1 and 2. Some of the insulating members are indicated at 27 in FIGS. 2, 3 and 4. The variable speed drive for the chains is diagramatically indicated at 15 in FIG. 1 which drives the sprockets 19 at the left end of the tank 14 as one views FIG. 1. The other pair of sprockets 19 at the right end of the tank 14 as one views FIG. 1 are idler sprockets. The tank 14 extends between the standards 18 and is connected to each standard for support, the tank having a closed bottom and open top is best shown in FIG. 4 which also indicates the height of the solution S which also appears in FIG. 3, the level of which is always above the loops of the wire during operation.

Extending throughout in a general horizontal direction substantially the full length of the tank 14 is a pair of spaced apart steel tracks 28 and 30 designed to support by sliding contact therewith the pair of chains 21 and 22, the sliding supporting relationship being more clearly seen in referring to FIGS. 3 and 4. With reference to FIG. 1, it will be noted that the tracks 28 and 30 and associated chains 21 and 22 are arranged to converge toward each other from right to left as one views FIG. 1. The particular angle of convergence is determined to provide the proper support, yet allow complete exposure of the wire for uniform plating or treatment of the underneath surface of the wire and will vary as the parameters of the system and wire size indicate. In the illustrated case the angle of taper of the two chains is approximately $\frac{1}{2}°$ which assurs that the wire will not contact the chains in the same place along its travel. While an angular arrangement of the tracks 28 and 30 has been illustrated, in many applications the tracks can be arranged parallel to each other with no adverse results in uniform plating, and in other arrangements wire displacement members can be provided if necessary to displace the wire relative to the chains during the plating process to assure uniform plating.

In referring again to FIG. 4, the upper tank 14 is provided with horizontal support bars 36 for connection to 38, the positive electrical source, i.e., an anode source. Arranged on the support bars 36 are two of a number of anode trays 40 so positioned that they immediately underlie the lower surface of the wire W and substantially extend the full width and length thereof.

FIG. 3 also shows more clearly the desired supporting relationship between the wire W and the vertical and horizontal links of chains 21 and 22, and the electrolytic solution S.

The negative charge of the system is provided by an electrical connection 42 which is connected to each track 28 and 30 by connectors 44 constituting the tracks, the cathode of the system, the connectors 44 and the tracks being carried by, and insulated from tank 14 as shown in FIG. 3. Thus it should be noted that the chains are arranged between the wire and tracks or cathodes and transfer the current from the tracks to the wire. Also, in FIG. 3 tank 14 as shown, has an opening 48 at each end through which the solution S runs out of tank 14 into both the left hand and right hand standard 18 from which it passes into an outlet 50, and returns to the holding tank 10. The arrows associated with the drive sprocket 19 and idler sprocket 20 indicates the direction of rotation thereof and the direction of travel of the chains 21 and 22.

It can now be seen that steel tracks, 28 and 30, and steel chains, 21 and 22, are, in fact, the same electrical potential (cathodic) as the wire loop pattern and will have the same affinity to be electro-plated as the wire loop pattern. With the exception of the top surface of the tracks, all other track surfaces and connectors can be rubber covered or plastic coated to resist being plated. The top surface of the tracks will build up with electro-plated material but, within reason, this should not pose a problem. Several options are available to deal with electro-plated material building up on the chains beyond a point that is considered acceptable. The chains can be used until such time as the electro-plated build up becomes objectionable. Then they can be replaced with a spare set of chains. The original chains could be placed in the anode trays until the plated material has been removed. They would then be ready to use again when it becomes necessary. In another form the polarity of the rectifier could be reversed to make the chain and track anodic. This would make the anodes cathodic. The unit could then be operated during a non-productive period until some or all of the plated material on the tracks and chains has been removed. The polarity of the rectifier could then be returned to the normal electro-plating mode and production could then be resumed.

In a third arrangement an additional rectifier 52, shown in FIG. 2 could be utilized to energize tracks 54 and 56 arranged in the lower tank 10. The chains 21 and 22 would be supported and guided by these tracks in a manner similar to the way the chains are supported in the upper tank 14. The tracks 54–56 in the lower tank would be energized anodic. Removable steel members 58 would be mounted close to the chain as it is supported and slides on these tracks. These steel members would be energized cathodic and would, therefore, collect the plated material from the chain. This could be done either intermittently or continuously with no interruption of production. When the removable steel members, which are cathodic, become excessively plated, they could be removed and placed in the anode trays in the upper tank until the plate had been removed. In the meantime, a second set of these plates would be installed in the lower tank in order that production would continue.

Since the chain and track must operate at ground potential, the incoming and outgoing product remains at ground potential. This allows the electrolytic cell to be employed in several different ways. If the solution electrode is cathodic, the electrolyte solution is cathodic, so the chain and product can be de-plated or cleaned. In the very next solution area, with this common track, chain and product, a solution electrode and solution can be made anodic, and the product can be plated.

In now briefly describing the operation of the above described system let it be assumed the illustrated system is in condition to begin plating a continuous supply of steel wire in consecutive circular loops advancing to the position in the tank 14 as illustrated in FIG. 1.

The loops of wire will be deposited on top of chains 21 and 22 as shown in FIG. 3 during which time the chains are between the cathode (tracks 28–30) and the loops of wire, and will transfer the negative current to the loops of wire, thus plating the wire. Also contributing to this result is the fact that the chains 21 and 22 are arranged to converge toward each other from right to left as one views FIG. 1. The continuous sliding action between the tracks 28 and 30 and the chains 21 & 22 will alleviate the buildup of coating on the tracks, thereby assuring a long uninterrupted operating period.

It will be appreciated that the invention, while described in connection with an electrolytic plating process for steel wire, can be employed for coating or cleaning other materials such as straight lengths of rods or bar stock, either ferrous or non-ferrous in a continuous or batch process and can be employed for all other electrolytic treatments.

It is to be understood that while consecutive loops of wire are referred to, it is for the purpose of illustration only and not for the purpose of limitation. It is also understood that while electro-plating is referred to, it is for the purpose of illustration only and that the scope of the invention is to include any and all electro-chemical reactions.

In accordance with the provisions of the patent statutes, I have explained the principle and operation of my invention, and have illustrated and described what I consider to represent the best embodiment thereof.

I claim:

1. An electrolytic cell for processing in a generally horizontal path material such as wire, rod or bar stock while passing through the electrolytic cell comprising:

a receptacle, a conveying means for receiving and supporting said material while passing through said receptacle, said conveying means including a continuous electrically charged chain means, said chain means being made up of members that support the said material during its travel through said receptacle.

2. In an electrolytic cell according to claim 1 wherein said wire takes the form of consecutive circular loops and said members of said chain means are constructed and arranged to support and to said electrically charge the consecutive circular loops of wire during their travel through said receptacle.

3. In an electrolytic cell according to claim 2 wherein said members of the chain means include interconnecting vertical and horizontal displaced links arranged in a manner that both the horizontal links and vertical links support the wire when the chain means is in its supporting position with said wire loops, said cell includes track means for receiving and guiding said vertical links upon the travel of said chain means through said receptacle.

4. In an electrolytic cell according to claim 1 wherein said chain means further comprises two spaced apart chains arranged to converge toward each other while passing through said receptacle when supporting said material.

5. In an electrolytic cell according to claim 1 wherein said electrolytic cell comprises an electro-chemical plating or cleaning cell, said cell constructed and arranged to cause the material to travel through the electrolyte of said cell, and wherein said material and chain means are electrically conductive, said cell including an electrically conductive track means arranged beneath said chain means in a supporting relationship therewith throughout a substantial part of the length of chain means while the chain means is supporting the material in said cell, said supporting relationship being such that an electrical transfer relationship is continuously established and maintained between the chain means, track means and material, and chain means is positioned between the material and track means, and means for connecting said track means to a current source to cause said track means to become the cathode or anode of said electrolytic cell.

6. In an electrolytic cell according to claim 5 wherein when said cell is employed as a plating cell said cell includes means for causing said track means to be a cathode, and includes an anode plating means arranged in said receptacle.

7. In an electrolytic cell according to claim 5 in which the supporting relationship of said track means and chain means is such that said chain means is caused to continuously slide over said track means.

8. In an electrolytic cell according to claim 5 wherein any detrimental plating build up on said chain means is controlled by providing a construction and arrangement wherein said chain means passes continuously through said electrolytic cell and a second electrolytic cell, the latter arranged to receive said chain means after said chain means has passed through said first electrolytic cell, said second electrolytic cell being operative to remove plating build up from said chain means before said chain means returns to said first electrolytic cell.

9. In an electrolytic cell according to claim 5, wherein said cell further includes means for reversing said cathodic condition of said track and therefore said chain means to an anodic condition to remove and control any detrimental plating build-up therefrom when said cell is in said electro-chemical cleaning mode.

* * * * *